US005955696A

United States Patent [19]

Meller

[11] Patent Number: 5,955,696

[45] **Date of Patent: *Sep. 21, 1999**

[54] SEMI-AUTOMATIC PISTOL HAVING EASY ACTION COCKING MECHANISM

[76] Inventor: Yehuda Meller, 9 Tsfat Street, Holon, Israel, 58552

[ * ] Notice: This patent issued on a continued prosecution application filed under 37 CFR 1.53(d), and is subject to the twenty year patent term provisions of 35 U.S.C. 154(a)(2).

[21] Appl. No.: 08/837,972

[22] Filed: Apr. 15, 1997

[30] Foreign Application Priority Data

Apr. 15, 1996 [IL] Israel ..... 117916

[51] Int. Cl.[6] ..... F41A 3/48

[52] U.S. Cl. ..... 89/196; 89/163; 89/173

[58] Field of Search ..... 89/163, 173, 196, 89/199; 42/18, 20, 22

[56] References Cited

U.S. PATENT DOCUMENTS

| | | | |
|---|---|---|---|
| 984,519 | 2/1911 | Browning | 89/163 |
| 4,887,510 | 12/1989 | Wynn | 89/163 |
| 4,972,760 | 11/1990 | McDonnell | 89/196 |

FOREIGN PATENT DOCUMENTS

| | | | |
|---|---|---|---|
| 300693 | 7/1921 | Germany | 89/163 |
| 25234 | 8/1908 | Sweden | 89/163 |
| M04804 | 10/1912 | United Kingdom . | |

OTHER PUBLICATIONS

European Search Report dated Jul. 22, 1998.

*Primary Examiner*—Stephen M. Johnson
*Attorney, Agent, or Firm*—Darby & Darby

[57] ABSTRACT

This invention discloses a semi-automatic pistol including a frame having a chamber for loading a cartridge, a barrel through which cartridges are fired, a slide normally in a forward position on the frame but movable rearwardly of the frame by the recoil produced by a fired cartridge, and a recoil spring normally coupled to the slide so as to be stressed by the rearward movement of the slide, and thereafter to relax to return the slide to its normal forward position and to load another cartridge into the chamber; characterized in that the pistol further includes a manually movable decoupling assembly which is manually movable from a coupling position, coupling the recoil spring to the slide, to a decoupling position decoupling the recoil spring from the slide and permitting the slide to be manually moved rearwardly of the frame and then to be returned to its normal forward position for loading a cartridge into the chamber.

14 Claims, 4 Drawing Sheets

FIG. 1
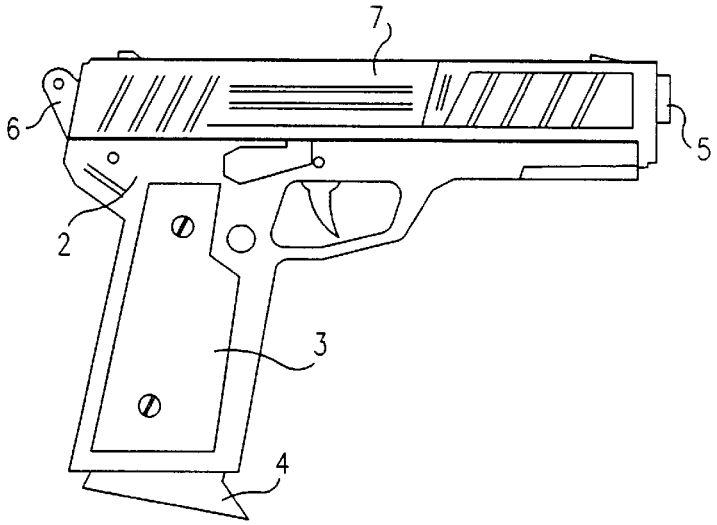
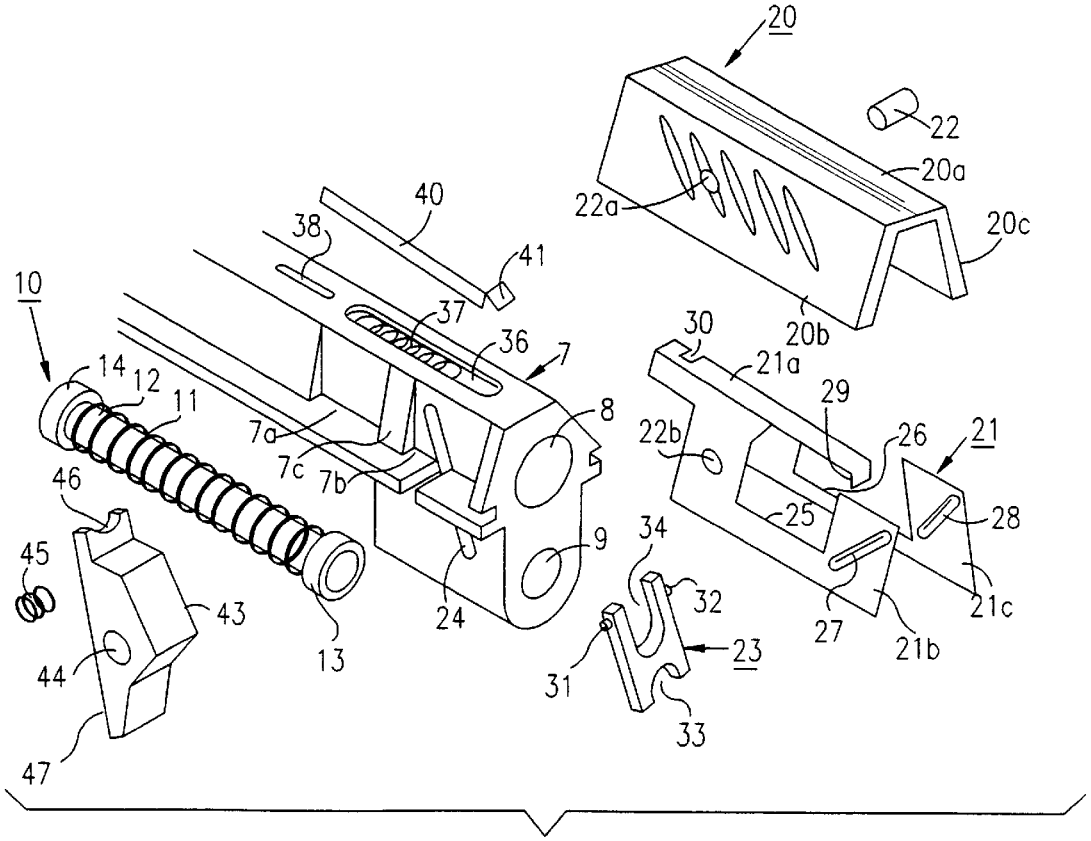
FIG. 2

FIG. 6
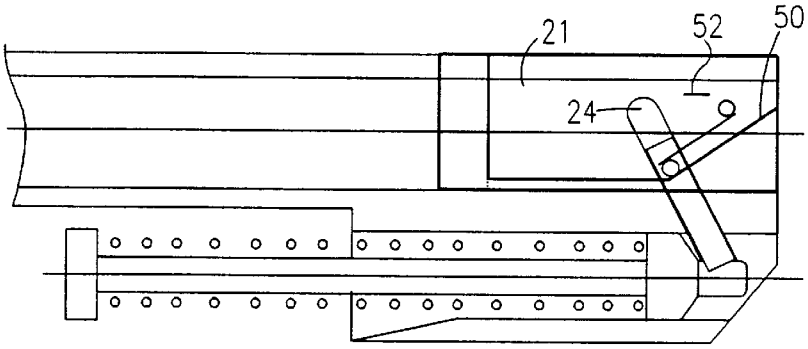
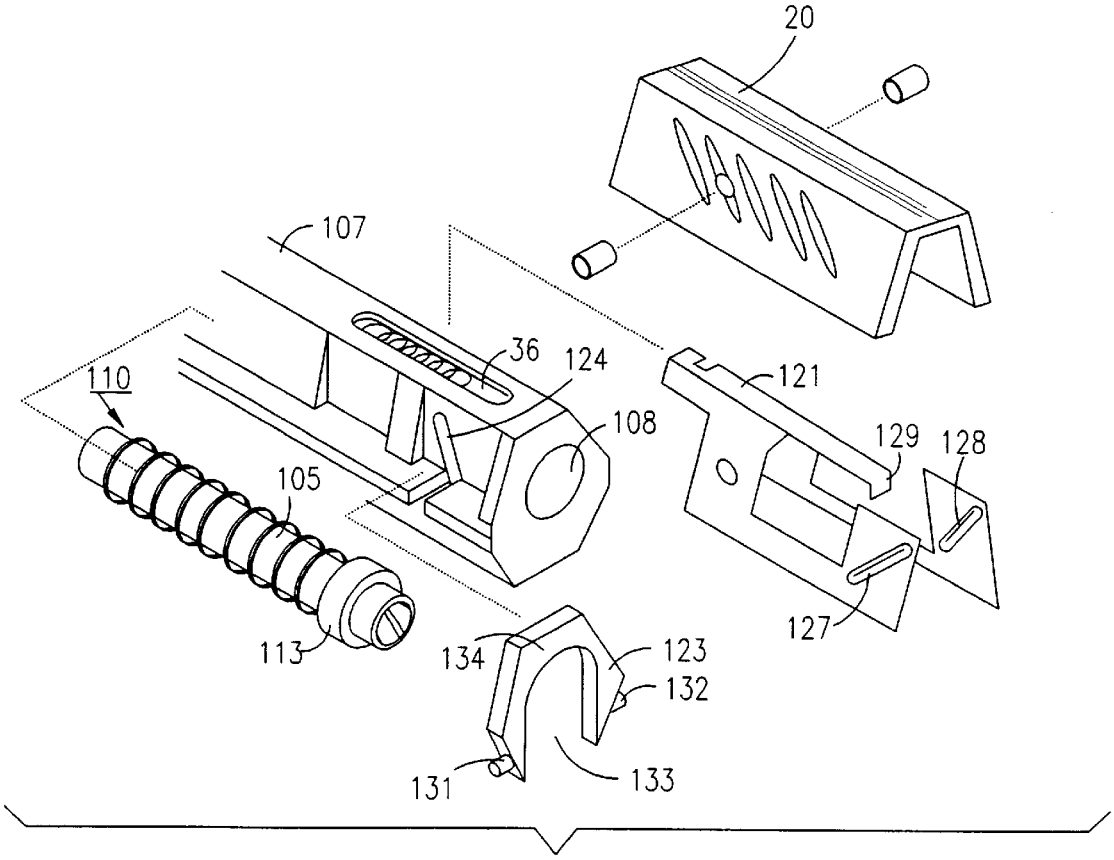
FIG. 7

SEMI-AUTOMATIC PISTOL HAVING EASY ACTION COCKING MECHANISM

FIELD OF THE INVENTION

The present invention relates to semi-automatic pistols, and particularly to an easy action cocking mechanism for such pistols.

BACKGROUND OF THE INVENTION

Semi-automatic pistols commonly include a slide normally in a forward position on the frame but movable rearwardly of the frame by the recoil produced by a fired cartridge, and a recoil spring coupled to the slide so as to be stressed by the rearward movement of the slide, and thereafter to relax to return the slide to its normal forward position and to load another cartridge into the chamber. Such pistols are loaded by inserting a magazine of cartridges into the butt of the pistol, and manually drawing the slide against the action of the recoil spring, and then releasing it, to load the first cartridge into the firing chamber and to cock the hammer. After each firing of a cartridge, the pistol thereafter utilizes the recoil produced by the firing of the cartridge to introduce a new cartridge into the chamber and to cock the pistol.

Manually pulling-back the slide in order to load the first cartridge requires a very substantial manual force, in the order of seven or more kilograms. Such a large manual force may be difficult to apply particularly by women or older persons. Moreover, this large manual force to initially load the pistol may limit the strength of the recoil spring that may be used, and thereby the recoil action absorbed by the recoil spring.

SUMMARY OF THE INVENTION

An object of the present invention is to provide a semi-automatic pistol having advantages in the above respects.

The present invention is herein described with respect to a semi-automatic pistol. However, it is appreciated to those skilled in the art that the present invention is not limited to a semi-automatic pistol but rather encompasses any other armament which includes a cocking mechanism. The terms semi-automatic pistol and those of other respective armaments are interchangeable.

According to a broad aspect of the present invention, there is provided a semi-automatic pistol including a frame having a chamber for loading a cartridge, a barrel through which cartridges are fired, a slide normally in a forward position on the frame but movable rearwardly of the frame by the recoil produced by a fired cartridge, and a recoil spring normally coupled to the slide so as to be stressed by the rearward movement of the slide, and thereafter to relax to return the slide to its normal forward position and to load another cartridge into the chamber; characterized in that the pistol further includes a manually movable decoupling assembly which is manually movable from a coupling position, coupling the recoil spring to the slide, to a decoupling position decoupling the recoil spring from the slide and permitting the slide to be manually moved rearwardly of the frame and then to be returned to its normal forward position for loading a cartridge into the chamber.

It will thus be seen that, in such a pistol, the slide may be manually decoupled from the recoil spring in order to permit the slide to be manually moved rearwardly and then to be returned forwardly with a minimum of effort when loading the first cartridge into the chamber, thereby relieving the user from the very substantial pulling force required to load the cartridge. In a preferred embodiment, the effort for manually drawing-back the slide is reduced by about 80%, e.g., from the usual 7.0 kilograms to about 1.5 kilograms, sufficient only to feed the next cartridge into the chamber and to cock the hammer. Moreover, since the recoil spring is decoupled from the slide during the first-cartridge loading operation, the pistol may use a stronger recoil spring, if desired, to better absorb the recoil action.

According to further features in the described preferred embodiment, the manually movable decoupling assembly includes a finger grip carried by the slide and manually movable with respect thereto, and a coupling member normally in a coupling position coupling the recoil spring to the slide, but movable, upon movement of the finger grip with respect to the slide, to a decoupling position decoupling the recoil spring from the slide. The finger grip has a lost-motion connection to the slide, is normally biased forwardly of the slide by a biasing spring, but is manually movable rearwardly of the frame such that the initial manual movement of the finger grip rearwardly of the frame does not move the slide but moves the coupling member from its coupling position to its decoupling position, and further manual movement of the finger grip rearwardly of the frame, and then forwardly of the frame, moves the slide with it while the slide is decoupled from the recoil spring.

Such a construction permits the user to load the first cartridge into the chamber by the same hand movements as before, except that in this case the user grips the finger grip carried by the slide, rather than the slide directly, which thereby automatically decouples the slide from the recoil spring as the finger grip traverses the lost-motion connection with respect to the slide. Further manual movement of the finger grip rearwardly, and then manual movement of the finger grip forwardly, also move the slide with it while the slide is decoupled from the recoil spring.

Additional features and advantages of the invention will be apparent from the description below.

BRIEF DESCRIPTION OF THE DRAWINGS

The invention is herein described, by way of example only, with reference to the accompanying drawings, wherein:

FIG. 1 is a side elevational view illustrating one form of semi-automatic pistol constructed in accordance with the present invention;

FIG. 2 is an exploded perspective view illustrating mainly the manually movable decoupling assembly to be included in a standard semi-automatic pistol in accordance with one embodiment of the invention;

FIG. 6 is a view similar to that of FIG. 3 but illustrating a modification in the construction of the decoupling assembly; and FIG. 7 is an exploded three-dimensional view illustrating the main parts of a manually movable decoupling assembly in accordance with a second embodiment of the invention.

DETAILED DESCRIPTION OF THE EMBODIMENTS

Figure 3:
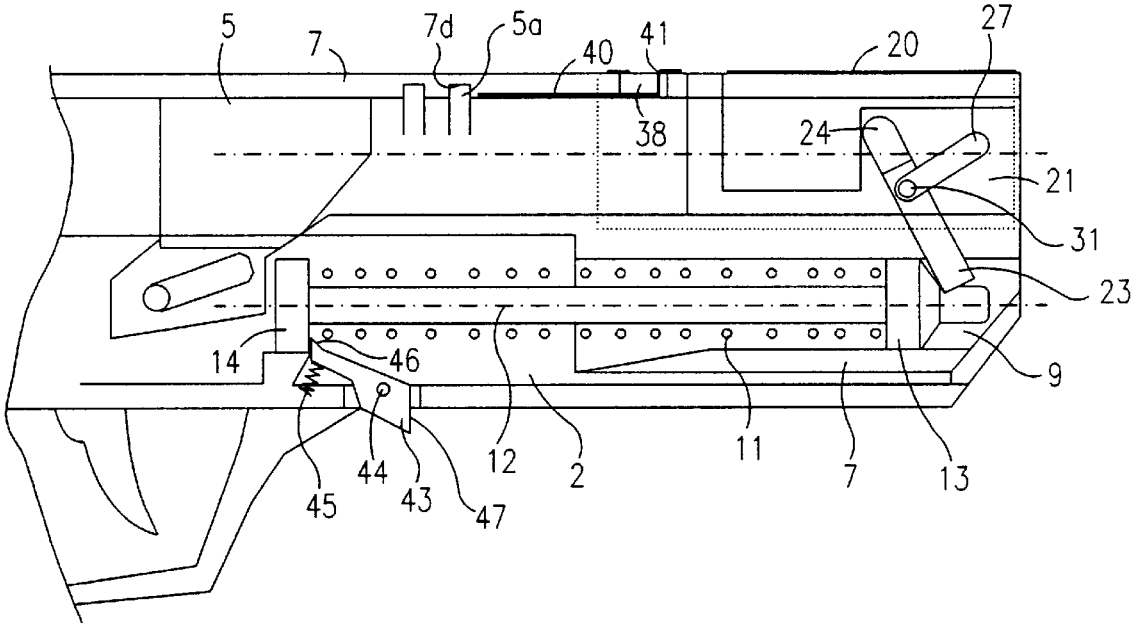
FIG. 3 illustrates the main parts of the decoupling assembly shown in FIG. 2 in their normal positions.

The semi-automatic pistol illustrated in FIG. 1 is a known type pistol. It includes a frame 2 having a butt 3 for receiving a magazine 4 carrying cartridges (not shown) to be loaded into the chamber (not shown) at the rear end of its barrel 5 through which the cartridges are fired by actuating a hammer 6. Frame 2 further includes a slide 7 formed with a bore 8 (FIG. 2) for receiving barrel 5, and further formed with a bore 9 for receiving a recoil spring assembly 10. Assembly 10 includes a coiled spring 11 received on a central rod 12. The front end of the spring 11 includes a collar 13 slidable along the rod 12 when the spring 11 is compressed. The rear end of rod 12 is formed with an enlarged head 14 engageable with a fixed element of the frame 2 to prevent movement of the rod 12 during the compression of the spring 11.

In the conventional pistol of this type, the front end of bore 9 is formed with an annular shoulder (not shown) engageable with collar 13, such that coiled spring 11 normally urges the slide 7 to a forward position on the frame 2, but is movable rearwardly of the frame 2 by the recoil produced when a cartridge is fired, or when manually cocked. Spring 11, being thus normally coupled to the slide 7, is stressed (i.e., compressed) by the rearward movement of the slide 7 as a result of the recoil produced by the fired cartridge, and thereafter relaxes (i.e., expands) to return the slide 7 to its normal forward position, while loading another cartridge into the chamber and cocking the hammer 6 in preparation for firing the next cartridge.

As described earlier, whereas the rearward movement of the slide 7 to reload the chamber with the new cartridge is effected automatically by the recoil produced by a fired cartridge, the movement of the slide 7 for introducing the first cartridge into the chamber must be done manually, which requires considerable manual effort to overcome the force of the recoil spring 11.

The present invention provides a manually movable decoupling assembly which is manually movable from its normal coupling position, coupling the recoil spring 11 to the slide 7, to a decoupling position decoupling the spring 11 from the slide 7, thereby permitting the slide 7 to be manually moved only with a relatively small effort rearwardly of the frame 2 and then forwardly to its normal position for loading the first cartridge into the chamber. To simplify the description, only those elements involved in this operation of manually decoupling the slide 7 from the recoil spring 11 are illustrated in the drawings and described below.

The main components of the manually movable decoupling assembly are illustrated in FIG. 2. They include a finger grip 20 carried on slide 7, an actuator member 21 secured to finger grip 20 by a pin 22 passing through aligned holes 22*a*, 22*b* therein, and a coupling member 23 receivable within an inclined slot 24 in slide 7 and movable by actuator member 21 either to a lower coupling position with respect to recoil spring 11 (FIG. 3) or to an upper decoupled position (FIG. 4*a*, 4*b*) with respect to spring 11.

Finger grip 20 is preferably made of a plastic material. It is formed with a central strip 20*a* to overlie the upper surface of slide 7, and a pair of diverging side strips 20*b*, 20*c* to straddle the opposite sides of the slide 7.

Actuator member 21, which is secured to finger grip 20 by pin 22, is similarly formed with a central strip 21*a* to overlie the upper edge of slide 7, and with a pair of diverging side strips 21*b*, 21*c* to straddle the opposite sides of the slide 7. Side strips 21*b*, 21*c* are formed with cutouts 25, 26 open at their tops, and with inclined closed slots 27, 28 forwardly of the outputs. The forward end of the center strip 21*a* is formed with a depending lug 29 overlying the cutouts 25, 26, and the rear end of the center strip is formed with an edge slot 30.

Coupling member 23 is in the form of a metal plate of a thickness to be received within the inclined slot 24 in slide 7. A pair of projecting pins or rollers 31, 32 are carried at the opposite sides at the upper end of coupling member 23 and are receivable within the inclined slots 27, 28 formed in the side strips 21*b*, 21*c* of the actuator member 21. The lower end of coupling member 23 is formed with a semi-circular recess 33 conforming to the curvature of the center rod 12 in the recoil spring assembly 10; and the upper end of coupling member 23 is formed with a semi- circular recess 34 conforming to the curvature of the barrel 5 within bore 8 of the slide 7.

The upper surface of slide 7 is formed with an elongated recess 36 receiving a biasing spring 37, and with an opening 38 at its rear end. Recess 36 in slide 7 receives depending lug 29 of the actuator member 21, and biasing spring 37 biases the actuator member 21 forwardly of the slide 7. Thus, lug 29 of the actuator member, movable within recess 36 of the slide 7, provides a lost-motion connection between the actuator member 21 and the slide, permitting the actuator member 21 to move a short distance rearwardly of the slide 7 before further rearward movement of the actuator member 21 also moves the slide 7 with it.

Slide 7 is formed with a pair of recesses 7*a*, 7*b*, separated by a shallower recess 7*c*, on each of its opposite sides for accommodating the side strips 21*b*, 21*c* of actuator member 21. These recesses also guide the movement of the actuator member 21, together with the finger grip 20, provided by the above lost-motion connection.

Figure 4A:
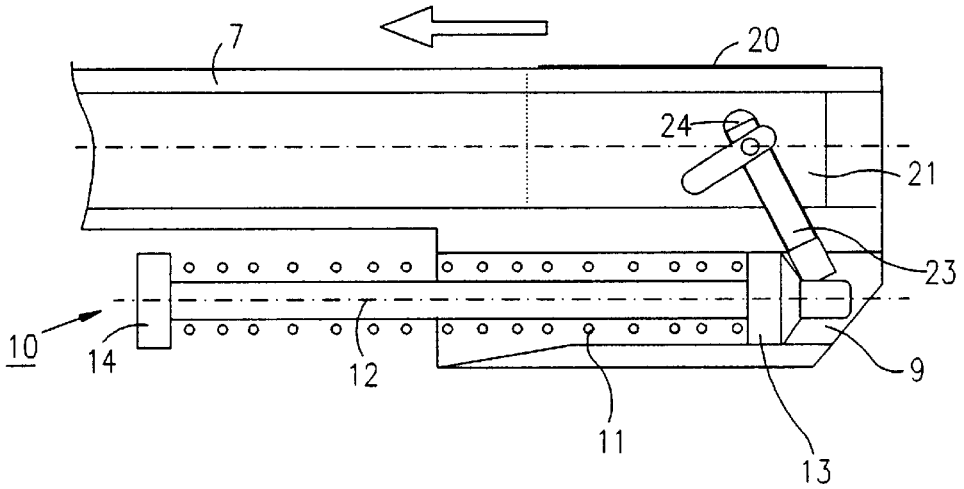
FIGS. 4*a* and 4*b* illustrate the main parts of the decoupling assembly in two stages during the manual cocking of the pistol.

In the conventional pistol, the barrel 5 is provided a plurality of teeth 5*a* FIG. 3) receivable with complementary recesses 7*d* formed in the slide 7 when the slide 7 is in its normal forward position and the barrel 5 is locked to the slide 7. The conventional pistol also includes mechanism (not shown herein) which assures that the foregoing conditions are present before the pistol can be fired. This mechanism may also be used in the novel construction of the present invention, particularly as illustrated in FIGS. 2 and 3, to prevent the pistol from being fired unless finger grip 20 and its actuator member 21 are in their normal forward positions with respect to slide 7.

For this purpose, slide 7 further includes a locking member 40 formed at its front end with an upstanding lug 41. As shown in FIG. 3, lug 41 normally passes through opening 38 in the slide when the slide is in its normal forward position, such that member 40 does not interfere with barrel teeth 5*a* being received within recesses 7*d* of the slide 7 which, as described above, locks the barrel 5 to the slide and enables the pistol to be fired. The center strip 21*a* of actuator member 21 thus prevents lug 41 from assuming the above position, and thereby prevents firing of the pistol, at all times except when lug 41 is not only aligned with opening 38, but also with slot 30, in actuator member 21. Since this occurs only when the actuator member 21 is in its forward position with respect to the slide 7, the pistol is prevented from firing except when actuator member 21, and finger grip 20 secured to it, are in their most forward position with respect to the slide 7. This also assures that coupling member 23 is in its lowermost position coupling the slide 7 to the recoil spring 11 before the pistol can be fired.

As briefly described earlier, in the conventional pistol construction the forward end of bore 9 receiving the recoil spring assembly 10 is formed with an annular shoulder engageable with collar 13 of the spring assembly to couple the slide 7 to the spring assembly 10. In the novel construction illustrated in the drawings, no such shoulder is formed in bore 9, but rather coupling member 23, when in its normal position as illustrated in FIG. 3, couples the slide 7 to the recoil spring assembly 10. A retainer member 43, preferably as shown in FIG. 2, is therefore provided normally engageable with the enlarged rear end 14 of the central rod 12 of the recoil spring assembly 10 for retaining the spring assembly against the frame 2 and within bore 9 of slide 7.

As shown in FIG. 3, retainer member 43 is pivotally mounted at 44 to the frame 2 and is biased by a spring 45 to bring its upper end 46 into engagement with the enlarged end 14 of the spring assembly rod 12 to normally hold the spring assembly 10 to frame 2 and within bore 9 of the slide 7. However, when retainer member 43 is pressed at its surface 47, on the side of its pivot 44 opposite to spring 45, the upper surface 46 of the retainer member 43 is lowered out of engagement with enlarged head 14 of rod 12, permitting the recoil spring assembly 10 to be removed from the frame 2, e.g., when disassembling the pistol.

Figure 4B:
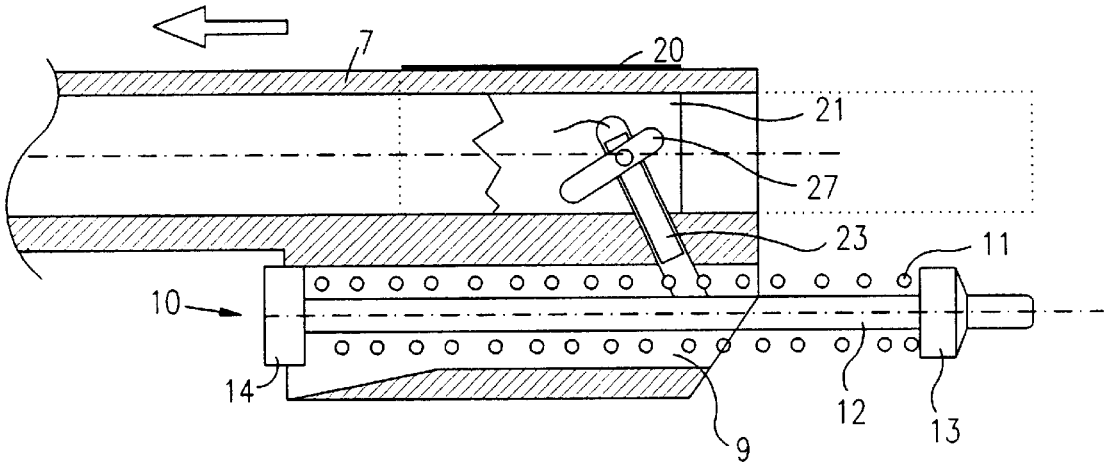

After the pistol has been loaded with a magazine 4 inserted into the pistol butt 3, the first cartridge is loaded into the pistol chamber and the hammer 6 cocked by moving the slide 7 rearwardly. However, whereas in the conventional pistol the initial cocking of the pistol requires considerable manual effort (e.g., about seven kilograms) to move the slide 7 rearwardly because of the recoil spring assembly 10, in the novel construction described above this initial cocking of the pistol is effected without loading the recoil spring assembly 10, thereby substantially reducing the manual effort required (e.g., to about 1.5 kilograms) for drawing back the slide 7. The manner in which this is done is illustrated in FIGS. 3–4*b*.

FIG. 3 illustrates the above-described parts of the pistol in their normal positions, wherein it will be seen that the finger grip 20 and its actuator member 21 are forwardly of the slide 7, and the coupling member 23 is in its lowermost position engageable with collar 13 of the recoil spring assembly 10.

To draw the slide 7 rearwardly while decoupled from the recoil spring assembly 10, finger grip 20 is manually gripped between the user's fingers and moved rearwardly with respect to slide 7. This is permitted by the lost-motion connection between lug 29 of actuator member 21 moving within recess 36 of slide 7, and within the side recesses 7*a*, 7*b* of the slide. This movement of actuator member 21 with respect to slide 7 occurs for a distance, e.g., about 8 mm. During this movement of actuator member 21 with respect to slide 7, coupling member 23 is raised relative to slide 7 by virtue of its projections 31, 32 received within the closed inclined slots 27, 28 of the actuator member. Coupling member 23 is thus raised within inclined slot 24 of the slide 7 to clear collar 13 of the recoil spring assembly 10 (FIG. 4*a*), which occurs at the end of this lost-motion movement of finger grip 20. Further rearward movement of finger grip 20 also moves the slide 7 rearwardly of the frame 2, but since coupling member 23 is now decoupled from collar 13 of the recoil spring assembly 10, this further rearward movement of the slide is not resisted by the recoil spring assembly 10 and as shown in FIG. 4*b*, does not compress spring 11 of that assembly 10.

After slide 7 has thus been manually moved to its rearward position while decoupled from the recoil spring assembly 10, it is then manually moved to its normal forward position. This introduces the first cartridge of the magazine into the pistol chamber and also cocks the hammer 6 in the conventional manner. As described earlier, lug 41 of locking member 40 not only assures that the slide 7 must be in its forward position with respect to the pistol frame 2, but also that actuator member 21 and its finger grip 20 must be in their forward positions with respect to the slide 7, before the pistol can fire.

Figure 5:
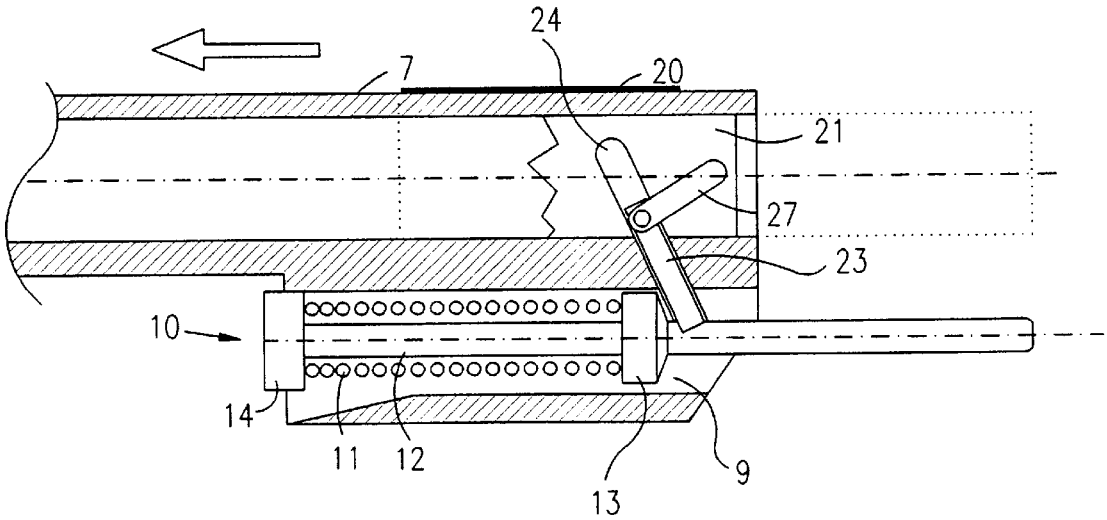
FIG. 5 illustrates the main parts of the decoupling assembly during the normal cocking of the pistol by the recoil spring after a cartridge has been fired.

After the pistol has thus been loaded with the first cartridge and cocked ready for firing, it therefore operates in the conventional manner to reload the chamber with a new cartridge after each firing since coupling member 23 is in its normal lower position, as shown in FIG. 5, thereby coupling the recoil spring assembly 10 to the slide 7.

FIG. 6 illustrates a modification in the construction, wherein the actuator member 21, instead of being provided with closed inclined slots 27, 28 for moving the coupling member 23 from its lower coupling position to its upper decoupling position, is formed with open cam surfaces 50. In this case, piano springs 52 are provided engageable with the coupling member side projections 31, 32 to urge them downwardly into engagement with these open cam surfaces 50.

FIG. 7 illustrates the invention applied to a semi-automatic pistol of the type wherein the slide 107 is provided with but a single bore 108 for the barrel, and the recoil spring assembly 110 is received within the same bore 108 and encloses the barrel 105. The finger grip 120 and the actuator member 121 are of the same construction as described above. In this case, however, the coupling member 123 is of a modified construction, being provided with a cavity 133 only at its lower end to accommodate the recoil spring assembly 110 and the barrel 105 within it. Coupling member 123 is similarly formed with two projections 131, 132 on its opposite sides, received within the closed cam slot 127, 128 formed in the actuator member, so as to raise and lower the coupling member 123 within slot 124 of the slide.

Thus, when the coupling member 123 is in its foremost position with respect to the slide 107, the upper end 134 of the coupling member 123 engages collar 113 of the recoil spring assembly 110 to couple the slide 107 to the recoil spring assembly 110; but when actuator member 121 is moved rearwardly of the slide 107 for the above-described lost-motion movement permitted by lug 129 movable within recess 136, coupling member 123 is raised out of engagement with collar 113, thereby permitting the rear movement of the slide 107 to be effected manually without compressing the spring assembly 110 in the same manner as described above with respect to FIGS. 1–6.

While the invention has been described with respect to two preferred embodiments, it will be appreciated that these are set forth merely for purposes of example, and that many variations may be made. For example, whereas in the illustrated embodiment the return movement of the slide, when moved manually in the rearward direction, is also effected manually, it will be appreciated that this return movement could be effected by an additional spring which is substantially lighter than the recoil spring and which is not decoupled from the slide during the manual rearward movement of the slide. Many other variations, modifications and applications of the invention will be apparent.

What is claimed is:

1. A semi-automatic pistol including a frame having a chamber for loading a cartridge, a barrel through which cartridges are fired, a slide normally in a forward position on the frame but movable rearwardly of the frame by the recoil produced by a fired cartridge and a recoil spring normally coupled to the slide so as to be stressed by the rearward movement of the slide, and thereafter to relax to return the slide to its normal forward position and to load another cartridge into the chamber; said pistol further including a manually movable decoupling assembly which is manually movable from a coupling position coupling the recoil spring to the slide, to a decoupling position decoupling the recoil spring from the slide and permitting the slide to be manually moved rearwardly of the frame and then to be returned to its normal forward position, by which means a cartridge is loadable into the chamber without stressing said recoil spring; said manually movable decoupling assembly includes a finger grip carried by said slide and manually movable with respect thereto, and a coupling member normally in a coupling position coupling the recoil spring to the slide, but movable, upon movement of said finger grip with respect to said slide, to a decoupling position decoupling the recoil spring from the slide;

wherein said finger grip has a lost-motion connection to the slide, is normally biased forwardly of the slide by a biasing spring, but is manually movable rearwardly of the frame such that the initial manual movement of the finger grip rearwardly of the frame does not move the slide but moves the coupling member from its coupling position to its decoupling position, and further manual movement of the finger grip rearwardly of the frame also moves the slide with it while the slide is decoupled from the recoil spring.

2. The pistol according to claim 1, wherein said manually movable decoupling assembly further includes an actuator member secured to said finger grip so as to movable therewith from a normal forward position to a rearward position with respect to the slide; said actuator member including cam means cooperable with said coupling member such that when the actuator member moved from said normal forward position to said rearward position, it moves the coupling member from its coupling position to its decoupling position.

3. The pistol according to claim 2, wherein said actuator member is of U-shape configuration and includes a center strip to overlie the slide, and a pair of side strips straddling the opposite sides of the slide and also straddling the coupling member.

4. The pistol according to claim 3, wherein said cam means includes cam surfaces formed in said side strips of the actuator member inclined with respect to the direction of movement of slide engaging projections on respectively opposite sides of the coupling member such that the cam surfaces lower the coupling member to its coupling position in the forward position of the finger grip and the actuator member with respect to the slide, and raise the coupling member to its decoupling position in the rearward position of the finger grip and the actuator member with respect to the slide.

5. The pistol according to claim 4, wherein said cam surfaces are closed slots formed in the side strips of the actuator member.

6. The pistol according to claim 4, wherein said cam surfaces are formed in the side strips of the actuator member and said finger grip further includes urging springs urging the slide engaging projections on the respectively opposite sides of the coupling member against said cam surfaces.

7. The pistol according to claim 3, wherein the opposite sides of said slide are recessed to accommodate said side strips of the actuator member.

8. The pistol according to claim 3, herein said center strip of the actuator member includes a lug engageable by said biasing spring for biasing said actuator member, and the finger grip secured thereto, to its normal forward position on the slide.

9. The pistol according to claim 3, wherein said center strip of the actuator member further includes a slot located to receive a lug carried by the slide when the actuator member is in its normal forward position with respect to the slide, which lug permits movement of the slide to its normal forward position, and firing the pistol, only when received within said slot.

10. The pistol according to claim 1, wherein said coupling member is in the form of a plate movable within a slot formed in the slide to said coupling and decoupling positions of the coupling member.

11. The pistol according to claim 10, wherein said recoil spring is a coiled spring having a collar at the front end of the spring, said coupling member being engageable with said collar in the coupling position of the coupling member, and disengageable from said collar in the decoupling position of the coupling member.

12. The pistol according to claim 11, wherein said recoil spring is received on a central rod, the lower edge of said coupling member being of recessed configuration to accommodate said central rod in the lower coupling position of the coupling member, the upper end of said coupling member being of recessed configuration to accommodate the pistol barrel in the upper decoupling position of the coupling member.

13. The pistol according to either of claims 11 or 12, wherein the rear end of said rod includes an enlarged head, said pistol including a retainer member normally engaging said enlarged head but manually movable to disengage said enlarged head to permit removal of the recoil spring from the pistol.

14. The pistol according to claim 11, wherein said coiled spring encloses the barrel of said pistol, the lower end of the coupling member being formed with an elongated cavity to accommodate said barrel.

* * * * *